United States Patent [19]

Happach

[11] 4,004,260

[45] Jan. 18, 1977

[54] POWER RELAY

[75] Inventor: Anton Happach, Munich, Germany

[73] Assignee: Schaltbau Gesellschaft mbH, Munich, Germany

[22] Filed: June 26, 1975

[21] Appl. No.: 590,416

[30] Foreign Application Priority Data

July 12, 1974 Germany ..... 2433536

[52] U.S. Cl. ..... 335/202; 335/128; 335/203

[51] Int. Cl.[2] ..... H01H 85/02

[58] Field of Search ..... 335/128, 132, 187, 192, 335/202, 203

[56] References Cited

UNITED STATES PATENTS

| | | | |
|---|---|---|---|
| 3,076,073 | 1/1963 | Townsend | 335/200 X |
| 3,214,534 | 10/1965 | Pihl | 335/187 X |
| 3,517,358 | 6/1970 | Davis | 335/192 |

*Primary Examiner*—J D Miller
*Assistant Examiner*—Fred E. Bell
*Attorney, Agent, or Firm*—Ralf H. Siegemund

[57] ABSTRACT

The relay has a tube as coil/core carrier with end flanges, one flange being continued in a box like enclosure containing and pivoting the armature. Contact pieces reach into the enclosure, while a nose on the armature extends out of the enclosure for limiting the armature stroke and for actuating an auxiliary switch. A spring inside of the electromagnet bears against an armature plate which is pivoted on the yoke arm ends; the yoke is fastened to an exposed outer end of the magnet. The counter contacts are suspended by springs on the armature.

11 Claims, 3 Drawing Figures

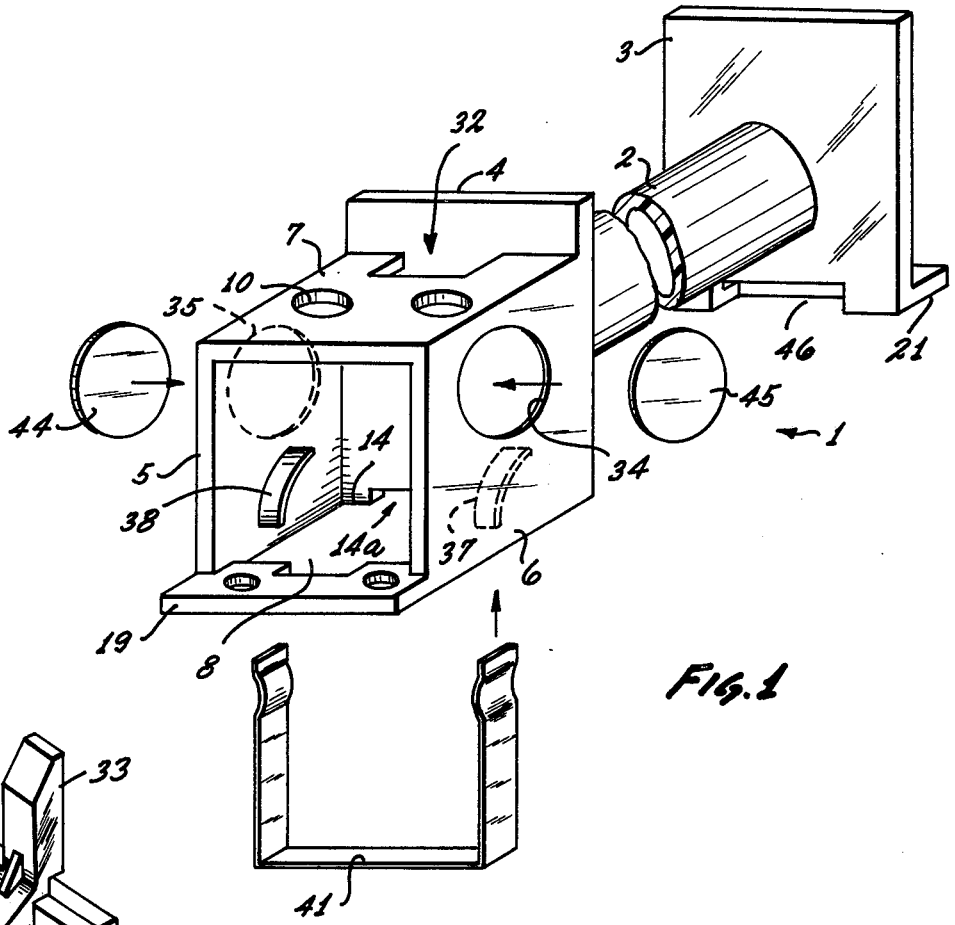
Fig. 1
Fig. 2
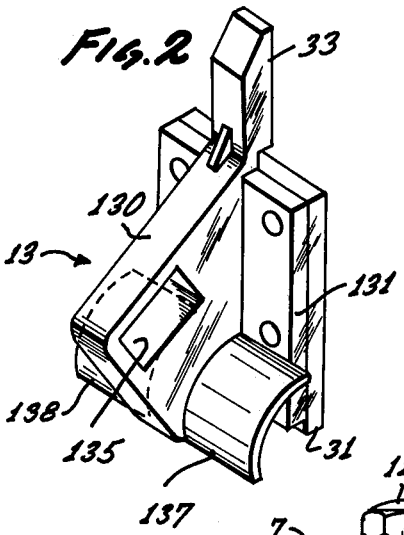
Fig. 3
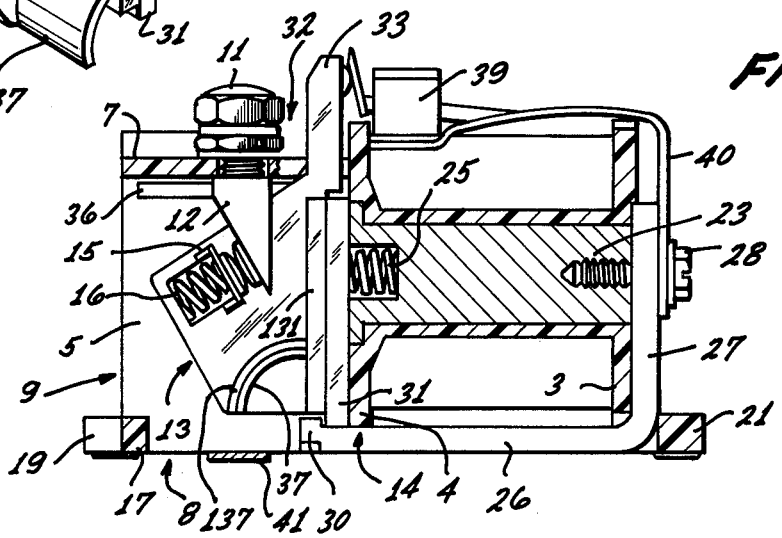

POWER RELAY

BACKGROUND OF THE INVENTION

The present invention relates to a relay or similar electromagnetic device with pivotable armature. More particularly, the invention relates to devices of that type for use in d.c. circuits and here particularly for switching power up to several tens of kilowatts.

Power relays and other devices with pivotable armature, are usually constructed in that the electromagnet with yoke; the contact system; and the arc extinguishing equipment, are built separately, and the relay as a whole is subsequently assembled from such subassemblies. This approach of providing subassemblies at first and of completing them prior to completion of the relay as a whole is expensive from various points of view, are inherently results in a bulkier construction than actually necessary.

DESCRIPTION OF THE INVENTION

It is an object of the present invention to provide a new and improved power relay or the like which is of compact construction, and easy and inexpensive to make.

The principle underlying the invention is the utilization of the concept of sharing in that any part does not just perform specific functions, but additional ones or supports the function of juxtaposed elements.

It is a specific object of the present invention to improve a relay with pivot armature having a tubular body of insulating material as coil carrier with flanges at both ends and receiving the magnetizable core for the relay.

In accordance with the preferred embodiment of the invention, the relay as set forth in the specific object and to be improved, is constructed in that one of the end flanges is completed into a box like enclosure but with an open side opposite the one flange and also with an open bottom. The top side (arbitrarily defined as the side opposite the open bottom) has at least one opening to which is fastened a contact piece projecting into the box like enclosure. The two side walls of the box carry guide elements on which rides the armature for pivoting in front of the magnetizable core in the tube. The armature carries a, preferably spring loaded, counter contact and has or includes a soft iron plate that pivots directly in front of the core between a position coplanar with the one flange (and, possibly, in abutment therewith) and a pivot position which is preferably limited by another opening in the said top through which projects a nose which is part of the armature. That nose may be used additionally as actuator for an auxiliary switch external to the box.

The invention therefore, provides a relay structure in which there is an inherent separation of parts inside of the box and of parts outside thereof, the latter being the coil-core structure respectively on and in the tube as it extends from the box. The box is rather easily accessible by having two of its six sides open to permit ready insertion of the otherwise completed armature while each of the remaining sides has one or several support functions. The sides carrying and guiding the armature on the inside may additionally have blind bores on the outside for receiving permanent magnets which provide for magnetic blowing for extinguishing any arc. A magnetically conductive clip or the like extending under the bottom may hold the magnets in place.

The relay usually requires means for restoring the position of the armature for de-energized coil. For this the core end facing the box may conveniently be provided with a bore receiving a spring which bears against the armature plate. The relay usually requires also a magnetic return path, which presently is to be provided by an L shaped yoke whose short arm is bolted to the other end of the core and whose long arm ends in lugs, projections or the like projecting into the bottom and providing also the pivot bearing for the armature plate.

The box may be provided with a ledge interconnecting the corners of the sides along the region where the two open sides meet. That ledge may be coplanar with a ridge on the flange on the other end of the tube, and together they provide a fastening facility for the relay.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is an isometric view of the support structure for the components of a power relay constructed in accordance with the preferred embodiment of the invention;

FIG. 2 is a section view through the same relay; and

FIG. 3 is a perspective view of the armature.

Proceeding now to the detailed description of the drawings, reference numeral 1 refers to the basic body, frame or support structure for the relay which includes a tube 2. The tube 2 is open at both ends and carries rectangular or square shaped flanges 3 and 4 respectively at these ends.

Flange 4 is continued in a box like casing or enclosure with three rectangular walls 5, 6 and 7. For convenience of designation, 6 and 7 can be called side walls and 7 is a top wall. That "box" has an open bottom 8, with a front ledge 19. The ledge 19 has openings by means of which the frame part of body 1 can be fastened to a support. The ridge 21 on flange 3 has the same purpose and is provided with openings accordingly.

The front of the box (as to the view of FIG. 1) is likewise open; specifically, the box has an open wall 9 opposite flange 4. The parts 4 through 7 together define a mounting space or cavity which is accessible from two sides. The walls 4 to 7 and bridge 19 may be integral with the flange 4 and with each other, or interconnected by means of bonding etc. All these parts may be rectangular or square shaped.

The upper, central wall 7 has two round apertures 10 for fastening of electrical connectors 11 as well as of stationary contacts 12 for the current to be governed by that relay. Specifically, contact pieces 12 each with a obliquely positioned contact face project respectively through these openings 10, and contact connections e.g. bolts 11 provide for physical connection of these contact pieces to that top wall 7 as well as fastening connection to wires for electric current (not shown). The top wall 7 has an additional opening 32 through which projects a portion of a carrier 13, namely a nose 33.

The two parallel sides 5 and 6 have curved, internally located cams or guides 38 and 37 respectively for pivoting the armature. The armature carrier 13 is a plastic body which has a central flat element 130 from which extends the nose 33, and being integral with a plate 131 to which is bolted a soft iron plate 31 which is the magnetizable portion of the armature. Concave cylindrical segments 137, 138 extend sideways from plate 131 for riding on the guides 37, 38 so that the armature pivots on an axis which, approximately at least, coincides with the edge 14 of flange 4. Specifically, plate 31 extends somewhat beyond plate 131 and lodges for pivoting behind noses, lugs or projections 30. These projections 30 form a pivot bearing or cradle, together with the portion of the flange 4 adjacent to the open bottom 8.

The armature carrier element 130 has an opening 135 which is passed through by a contact bridge and carrier 13, and is held and biased in opening 135 by means of a spring 16. That bridge carries a pair of movable counter contacts, one on each side of plate 130 for respective cooperation with the stationary contacts 12, which extend along side of carrier plate 130 acting as a divider between the two sets of contacts.

As stated above, armature carrier 13 has additionally nose 33 which projects from the armature body through opening 32 in the housing. The latter opening limits the pivot motion of the armature carrier 13 in (in FIG. 2) up direction. The nose 33 may, in addition, be used as an external switch actuator operating for example a switch 39 which is mounted on the outside of the coil 27, by means of a bracket 40, which in turn is fastened to the magnetic core 23.

The walls 5 and 6 each have blind bores, i.e. flat recesses 34, 35 which do not traverse the walls. These flat bores or recesses receive for example permanent magnets 44 and 45 which act transversely to the displacement path of the contacts inside of the box and blow any arc that may develop. As schematically shown, also in exploded view like fashion, a U-shaped clip 41 may extend with its bottom portion across the bottom 8 and the legs hold the magnets 44 and 45 in place.

In order to properly guide the arm pursuant to the blowing action, horn elements 36 are secured to or integral with the contacts 12. The contacts 15 may have similar guide elements or horns along which an arc may migrate outwardly, towards the front opening in the box, and by operation of magnetic blowing action provided by the magnets 44, 45.

As has been mentioned already, the relay has a magnetic core 23 which is contained in tube 2. The relay coil 22 is wound around and disposed on the tube 2 and is located between flanges 3 and 4. An L shaped yoke 26 is bolted to the core 23 by means of the short arm of the L, using a bolt 28. The longer arm 29 extends over part of flange 3 through a slot 46 therein, along the coil 22 on tube 2 and beyond flange 4.

The yoke is provided with two projections 30 by means of which it reaches into the bottom opening 8 of the box. As stated, these projections 30 serve as pivot bearing for the soft-iron plate 31 on armature carrier plate 131, along and in cooperation with edge 14 of flange 4. The latter edge has a recess **14*a* into which is laid the long arm 29** of the yoke.

The (soft) magnetic core 23 has a front bore 23 where facing the armature plate 31 and a spring 25 bears against the bottom of that bore 24 while engaging the plate 31. This spring 25 restores a pivoted up position of the armature carrier 13 and of armature plate 31 when the energizing current does not flow through coil 22. The armature is actuated, i.e. pivoted up by that spring until the nose 33 abuts the upper edge, whereby pivot action results from pivoting of the one edge of plate 31 in the cradle defined by projections 30 and the adjacent edge of flange 14, and pivoting results also in slide motion of the armature carrier segments 137, 138 respectively on curved guides 37, 38. The armature is actuated in the opposite direction upon energization of the coil until e.g. the plate abuts flange 4. The front of the core 23 could be slightly receded from the front face of the core 23 so that plate 31 does not stick to the core.

The dual or multiple functions of the several parts is derivable from the Figure. For example, the yoke 26, 27 as fastened to the core, holds the core also in the tube because of its position through the slot in flange 3. The basic function of the yoke is to define the magnetic return path of the electromagnetic system, but is also establishes the pivot for the armature plate 31.

The core has its usual function, but the front opening serves also as retainer for the spring which restores the alternative armature position upon de-energization of the coil. The side walls 6, 7 are not just retention elements but hold the blower magnets and the guides for armature pivoting. Analogously, the top wall serves for contact fixing and armature limit (opening 32). In conjunction therewith, nose 33 is the element that limits the armature deflection and serves also as auxiliary actuator.

The assembly of the relay is quite simple, as the armature has to be merely slipped into the box-like enclosure until seated on guides 37, 38. The yoke ends 30 are then snapped beind the plate 31 and the short arm 27 of the yoke is then bolted to the core which has been previously inserted. Finally, the contact pieces 12 are inserted and fastened. The auxiliary switch if needed, is subsequently installed by fastening of the bracket as illustrated.

Following the assembly, front and bottom openings of the box could be closed by snap-on covers or in any other way, depending on the use. In other words, nothing of the construction precludes partial encapsulation. The relay may then be mounted wherever needed.

The invention is not limited to the embodiments described above but all changes and modifications thereof not constituting departures from the spirit and scope of the invention are intended to be included.

I claim:

1. A relay with pivotable armature, an energizible coil, a magnetizable core, and means for changing the position of the armature when not attracted by the core, comprising:

a tubular body, open at both ends and provided with first and second end flanges, the tubular body being the carrier for the coil and receiving the core;

a top wall and two side walls integral therewith or connected thereto and extending from two opposite edges of the top wall at right angles, the top wall and the side walls extending from the first flange to define therewith a box-like enclosure having an open side opposite the first flange and an open bottom opposite the top wall;

the top wall having at least one opening, there being a contact piece fastened to the top wall at the opening and projecting through the opening into the box-like enclosure;

guide means at said side walls inside of said enclosure for pivotally supporting the armature; and a counter contact on the armature for making contact with said contact piece and receding from the contact piece upon actuation of said armature.

2. A relay as in claim 1, wherein said core has a bore, and the means for changing includes a spring in the bore and acting against said armature having disposition in front of said bore.

3. Relay as in claim 1, wherein the armature includes a plate which, in the attracted position, abuts said first flange inside of said enclosure.

4. Relay as in claim 3 and including an L-shaped yoke with a short arm secured to the core adjacent said second flange, and a long arm extending to said box-like enclosure adjacent to the open bottom and having projections for pivotal support of said armature plate.

5. Relay as in claim 1, wherein the said top has another opening, the armature having a nose projecting through the opening for limiting the pivot displacement of the armature.

6. Relay as in claim 5 and including auxiliary switching means on the outside of said relay and actuated by said nose.

7. Relay as in claim 1, wherein said side walls have blind openings, and permanent magnets in said openings for providing for magnetic, arc-extinguishing blowing.

8. Relay as in claim 7 and including a clip for holding said magnets in said openings.

9. Relay as in claim 1 and including guide means on at least one of said counter contact and said contact piece for guiding any arc.

10. Relay as in claim 1 and including a ledge between the sides with openings for fastening the relay, and separating the open bottom from the open side.

11. Relay as in claim 10, wherein the first flange has a ridge coplanar with said ledge and also provided for fastening the relay.

* * * * *